US009944885B2

(12) United States Patent
Shi et al.

(10) Patent No.: US 9,944,885 B2
(45) Date of Patent: Apr. 17, 2018

(54) AQUEOUS LUBRICANT COMPOSITION, A METHOD FOR MAKING THE SAME AND USES THEREOF

(71) Applicant: Sustainalube AB, Luleå (SE)

(72) Inventors: Yijun Shi, Luleå (SE); Mattias Grahn, Luleå (SE); Roland Larsson, Luleå (SE)

(73) Assignee: Sustainalube AB, Luleå (SE)

( * ) Notice: Subject to any disclaimer, the term of this patent is extended or adjusted under 35 U.S.C. 154(b) by 0 days.

(21) Appl. No.: 15/038,918

(22) PCT Filed: Dec. 8, 2014

(86) PCT No.: PCT/EP2014/076862
§ 371 (c)(1),
(2) Date: May 24, 2016

(87) PCT Pub. No.: WO2015/086516
PCT Pub. Date: Jun. 18, 2015

(65) Prior Publication Data

US 2017/0022445 A1 Jan. 26, 2017

(30) Foreign Application Priority Data

Dec. 9, 2013 (SE) ..... 1351464

(51) Int. Cl.
*C10M 173/02* (2006.01)
*C10M 105/14* (2006.01)

(52) U.S. Cl.
CPC ..... *C10M 173/02* (2013.01); *C10M 2201/02* (2013.01); *C10M 2201/062* (2013.01); *C10M 2201/18* (2013.01); *C10M 2207/022* (2013.01); *C10M 2207/026* (2013.01); *C10M 2207/0225* (2013.01); *C10M 2207/044* (2013.01); *C10M 2207/046* (2013.01); *C10M 2209/126* (2013.01); *C10M 2215/02* (2013.01); *C10M 2215/04* (2013.01); *C10M 2215/042* (2013.01); *C10M 2223/04* (2013.01); *C10N 2210/01* (2013.01); *C10N 2210/02* (2013.01); *C10N 2230/10* (2013.01); *C10N 2230/64* (2013.01); *C10N 2240/40* (2013.01); *C10N 2240/52* (2013.01); *C10N 2240/58* (2013.01)

(58) Field of Classification Search
CPC ..... C10M 173/02; C10M 2207/0215; C10M 2207/022; C10M 2201/02; C10M 2201/062; C10M 2201/18; C10M 2207/026; C10M 2207/044; C10M 2207/046; C10M 2209/126; C10M 2215/02; C10M 2215/04; C10M 2215/042; C10M 2223/04; C10N 2210/01; C10N 2210/02; C10N 2230/10; C10N 2240/40; C10N 2240/52; C10N 2240/58
USPC ..... 508/154
See application file for complete search history.

(56) References Cited

U.S. PATENT DOCUMENTS

| | | | | |
|---|---|---|---|---|
| 2,694,645 | A * | 11/1954 | Gleim | C10L 1/1857 252/404 |
| 3,526,595 | A | 9/1970 | Pellaton | |
| 4,257,902 | A * | 3/1981 | Singer | C10M 3/00 106/38.23 |
| 4,390,440 | A * | 6/1983 | Schwartz | C10M 173/02 252/76 |
| 4,686,058 | A * | 8/1987 | Schwartz | C10M 3/00 252/73 |
| 2004/0038831 | A1* | 2/2004 | Eadie | B61K 3/00 508/110 |
| 2007/0161522 | A1* | 7/2007 | Cholli | C10M 141/00 508/545 |
| 2009/0242858 | A1* | 10/2009 | Palmerio | C10M 133/16 252/602 |
| 2012/0040875 | A1 | 2/2012 | Kupfer et al. | |

FOREIGN PATENT DOCUMENTS

| | | | |
|---|---|---|---|
| DE | 288169 | A5 | 3/1991 |
| FR | 2907790 | A1 | 5/2008 |
| GB | 2016041 | A | 9/1979 |
| WO | 2007/140182 | A1 | 12/2007 |

OTHER PUBLICATIONS

PCT International Search Report dated Mar. 19, 2015 from corresponding Application No. PCT/EP2014/076862, 4 pages.

* cited by examiner

*Primary Examiner* — James Goloboy
(74) *Attorney, Agent, or Firm* — Dilworth IP LLC

(57) ABSTRACT

The disclosure concerns an aqueous lubricant composition, characterized in that it comprises of: 50 wt % of water, 0.01-20 wt % of a thickening agent, 0.5-10 wt % of an antioxidant; 0.5-5 wt % of a pH regulating agent; and glycerol. There is also provided a method for manufacturing the aqueous lubricant composition, and uses of said aqueous lubricant composition.

19 Claims, No Drawings

AQUEOUS LUBRICANT COMPOSITION, A METHOD FOR MAKING THE SAME AND USES THEREOF

TECHNICAL FIELD

The present disclosure relates to lubricant compositions. More specifically, the present disclosure relates to an aqueous lubricant composition, a method for making such a composition and uses thereof.

BACKGROUND

Exposure of a solid surface with interfacing materials is known to lead to "wear", i.e. loss of material from the surface. Major types of wear include abrasion, erosion and corrosion. In the contact between two moving bodies there is usually a certain degree of friction. Excessive friction may lead to power losses and heating of the contact which is often undesired. The yearly worldwide economic losses and technical problems due to friction and wear are significant. Lubrication is a common way of minimizing and/or overcoming the problems associated with friction and wear. A large number of lubricant compositions for various purposes exist on the market.

A lubricant is often composed of a base fluid, traditionally a mineral oil and an additive package. The additive package may contain one or several chemical compounds designed to increase the performance of the lubricant. Examples of different kinds of additives include viscosity modifiers, detergents, dispersants, anti-wear additives, extreme pressure additives, friction modifiers, anti-corrosion agents and antioxidants.

Traditionally, lubricants for hydraulic and lubrication purposes are based on mineral-based oils. Mineral-based oils, including mixtures of alkanes in the C15 to C40 range from a non-vegetable source such as a distillate of petroleum, polyalphaolefin (PAO) and so on have good lubrication properties and contribute to reduction of friction and wear. However, lubricants from these mineral-based oils are not biodegradable and therefore remain in the eco-system for a long time, when they are released into the environment. In addition, these mineral-based oils are often toxic. For instance, contamination of the environment with mineral oil may make the soil unusable, water unfit for irrigation and sewage work inoperable. Even small amounts of mineral oil may have large and detrimental effects on the environment. For instance, one liter of oil released into the environment may cover an area of the size of a football pitch and contaminate as much as one million liters of water. Every year huge sums are spent by society and companies on cleaning and on measures to remedy damages due to leakage of mineral oil-based lubricants.

Many of the additives used in lubricants also have detrimental effects on the environment e.g. by showing low biodegradability or containing elements, such as sulfur or heavy metals, that are undesirable to release into the environment.

Economic and environmental concerns have therefore prompted the development of lubricants being less toxic or non-toxic as well as biodegradable. These so-called green lubricants are environmentally friendly, and are often synthetic ester-based lubricants or lubricants based on vegetable oil. For instance, the environmentally based lubricant may be based on rapeseed oil or sunflower oil. Often, the environmentally friendly lubricants are called green lubricants or environmentally considerate lubricants (ECLs). Compared to traditional mineral oil-based lubricants, these lubricants are much less harmful due to their lack of toxicity or very limited toxicity, and their relatively quick degradation into non-toxic residues in nature.

However, the performance and cost of environmentally friendly lubricants based on vegetable oil are often not as beneficial as the mineral-based lubricant equivalent. A vegetable based oil lubricant may cost twice as much as a mineral-based oil lubricant. Other problems associated with vegetable oils are low thermal and oxidation stabilities, narrow viscosity range and poor flow properties at low temperature. Further, parameters that are important in the context of lubrication such as friction and wear loss may not be good enough.

JP2011140631 discloses a lubrication composition comprising a base oil, a thickening agent, an antioxidant and the coenzyme Q. The base oil may be based on glycerides.

JP2011219690 discloses a lubricant grease composition comprising a triglyceride, an antioxidant and a thickener. The antioxidant is vitamin A or a derivative thereof.

JP2011162606 discloses a lubricating composition comprising a base oil, starch as thickening agent and antioxidants.

DD288169 discloses a lubricating composition comprising water, starch and glycerine.

Tribology International, 69(2014), 39-45 discloses studies of glycerol aqueous solutions as green lubricants, and comparison is made with rapeseed oil. The viscosity of glycerol is lowered to a desired value by addition of water. The friction coefficient of glycerol aqueous solutions having a water content of 30% or less is found to be lower than that of rapeseed oil. However, the wear volume loss, i.e. the volume loss of material that takes place in the contact area of the surface(s) during friction, of glycerol aqueous solutions is higher than that of rapeseed oil. It is stated that glycerol aqueous solutions have great potential as green lubricants and that their lubricating properties are much better than rapeseed oil, especially when the water content is below 20 wt %.

Conveniently, glycerol (which is also known as glycerin, glycerine and propane-1,2,3-triol) is easily available in large quantities and at low cost on the market. This is largely due to the rapidly growing production of bio-diesel where glycerol is formed as a byproduct, and novel applications of glycerol are therefore sought for.

The viscosity and freezing point of aqueous glycerol may be controlled by the amount of water mixed with the glycerol. Thus, by adding water to glycerol viscosity may be lowered to a desired value, while at the same time lowering the freezing point to below that of pure glycerol.

There is thus still a need for improving the properties and the performance of green lubricants.

It is an object of the present disclosure to overcome or at least mitigate some of the problems associated with lubricants such as green lubricants.

DESCRIPTION

In accordance with the present disclosure there is provided an aqueous lubricant composition. The aqueous lubricant composition is characterized in that it comprises:

5-50 wt % of water,
0.01-20 wt % of a thickening agent,
0.5-10 wt % of an antioxidant;
0.5-5 wt % of a pH regulating agent; and
glycerol.

The glycerol content may range from about 15 to about 93.99 wt %. For instance, the glycerol content may be about 40, 50, 60, 70, 80 or 85 wt %. Alternatively, the glycerol content may be as described in the Examples.

The aqueous lubricant composition may consist solely of water, glycerol, a thickening agent, an antioxidant and a pH regulating agent. Thus, there is provided an aqueous lubricant composition characterized in that it consists of:

5-50 wt % of water,
0.01-20 wt % of a thickening agent,
0.5-10 wt % of an antioxidant;
0.5-5 wt % of a pH regulating agent; and
glycerol as balance.

The glycerol content may range from about 15 to about 93.99 wt %. %. For instance, the glycerol content may be about 40, 50, 60, 70, 80 or 85 wt %. Alternatively, the glycerol content may be as described in the Examples. In this context, it is understood that after mixing all components the final weight of the composition constitutes 100%. In addition to the water, the thickening agent, the antioxidant and the pH regulating agent glycerol is added in an amount to achieve the final weight of the composition. The expression "glycerol as balance" is therefore understood to be the amount of glycerol added to achieve the final weight of the composition. As an example, a lubricant composition may consist of: 20 wt % of water, 0.01 wt % of thickener, 3 wt % of antioxidant, 0.05 wt % of pH regulating agent, and 76.94 wt % of glycerol.

The aqueous lubricant composition described herein may contain impurities and/or other components. The impurities may be present in or derive from the components of the aqueous lubricant composition. It will be appreciated that the presence of impurities and/or other components in the aqueous lubricant composition does not essentially affect the characteristics of the composition such as the wear volume loss, the friction coefficient and/or the viscosity. Thus, there is provided an aqueous lubricant composition characterized in that it essentially consists of 5-50 wt % of water,
0.01-20 wt % of a thickening agent,
0.5-10 wt % of an antioxidant;
0.5-5 wt % of a pH regulating agent; and
glycerol as balance.

The glycerol content may range from about 15 to about 93.99 wt %.

In this document, the amount of the components of the aqueous lubricant composition is expressed in wt % based on the total weight of the composition.

The aqueous lubricant composition described herein may be biodegradable. In this document, the term "biodegradable" means that lubricant composition may be consumed and/or broken down by microorganisms into compounds found in nature or compounds harmless or substantially harmless to nature. Biodegradable matter is generally organic material such as plant and animal matter and other substances originating from living organisms, or artificial materials that are similar enough to plant and animal matter to be put to use by microorganisms.

By mixing a thickening agent, an antioxidant and a pH regulating agent with water and glycerol in the amounts indicated herein, the aqueous lubricant composition will have a satisfactory viscosity, friction coefficient and/or wear volume loss. Compared to a corresponding composition consisting solely of water and glycerol, the friction coefficient of the biodegradable aqueous composition will be approximately the same or lower than that of the corresponding composition, while it will give rise to considerably lower wear volume loss when used in various applications.

The low wear volume loss of the aqueous lubricant composition described herein is a significant benefit, since a device onto which the lubricant composition is applied will undergo less wear and can be used for a longer time with few service interruptions and/or a minimum of maintenance. Unexpectedly, the combination of a thickener, an antioxidant and pH regulating agent significantly lowered the wear volume loss. As shown in the Examples, neither the addition of solely thickeners nor the addition of solely antioxidants to an aqueous glycerol solution can lower the wear volume loss to a value of the same magnitude as a green lubricant such as rapeseed oil. It has also been found that the presence of a pH regulating agent, in addition to regulating the pH, also has a significant impact on the lubrication properties by lowering the wear volume loss of the aqueous lubricant composition.

Further, due to the high content of water and glycerol the aqueous glycerol lubricant compositions described herein will have a minimally negative impact on the environment and can therefore advantageously be used in environment sensitive areas, for instance outdoor applications. In addition, the compositions described herein are expected to have a low freezing point such as −50° C. allowing for use in places where the temperature may be low. This is often the case for applications involving inter alia chain saws, hydraulic power machines and/or railroad tracks.

The glycerol used in the composition described herein is pure glycerol, i.e. propane-1,2,3-triol. Thus, in contrast to several earlier reported lubricant compositions the glycerol of the aqueous lubricant composition described herein is used in non-modified form, i.e. it is used as propane-1,2,3-triol, which is convenient and cost-effective when preparing the lubricant composition described herein.

As used herein, aqueous glycerol is intended to mean a mixture of water and glycerol. The expressions aqueous glycerol solution, glycerol aqueous solution and aqueous glycerol composition are used interchangeably.

The water content of the aqueous lubricant composition described herein may vary from about 5 to about 50 wt %. As used herein, wt % stands for weight percent. As an example, the water content of the biodegradable aqueous lubricant composition may be about 20 wt %. Further examples of a suitable water content of the aqueous lubricant composition are a water content from about 10 to about 30 wt %, from about 15 to about 30 wt %, from about 15 to about 25 wt %, from about 20 to about 30 wt %, from about 5 to about 50 wt %, from about 5 to about 40 wt %, from about 5 to about 30 wt %, from about 10 to about 30 wt %, from about 20 to about 50 wt %, from about 30 to about 50 wt % or from about 40 to about 50 wt %.

The thickening agent, which may also be denominated thickener, increases the viscosity of the aqueous lubricant composition described herein. In particular, the thickener increases the viscosity compared to a corresponding mixture of water and glycerol at 25° C.

The thickener may be present in an amount from about 0.01 to about 20 wt %, such as from about 0.01 to about 10 wt %. For instance, the amount of the thickener may be about 0.01, about 0.02, about 0.04, about 1 or about 10 wt %.

The thickening agents may be selected from the group consisting of: chitin, chitosan, dextrin, cellulose, starch, vegetable gums, hyaluronic acid or derivatives and/or mixtures thereof. Examples of cellulose thickers are, but not limited to these, sodium carboxymethyl cellulose and hydroxyethyl cellulose. The chitosan thickening agent may be hydroxyethyl chitosan.

In this document, vegetable gums intend agar. Agar is a gelatinous substance which may be obtained from algae or seaweed. The terms "vegetable gums" and "agar" are used interchangeably.

For instance, the thickening agent used in the aqueous composition described herein may be selected from the group consisting of sodium carboxymethyl cellulose, hydroxyethyl cellulose, hydroxyethyl chitosan, starch, vegetable gums, dextrin and hyaluronic acid. The amount of sodium carboxymethyl cellulose, hydroxyethyl cellulose, hydroxyethyl chitosan, and hyaluronic acid may range from about 0.01 to about 0.05 wt %, such as from about 0.01 to about 0.04 wt %. For instance, the amount of sodium carboxymethyl cellulose, hydroxyethyl cellulose, hydroxyethyl chitosan and hyaluronic acid may be about 0.01, 0.02, 0.03 or 0.04 wt %. The amount of starch or dextrin may be about 10 wt %.

As an example, the aqueous lubricant composition may consist of:

20 wt % of water, 0.01 to 10 wt % of thickening agent, 0.5 to 10 wt %, or 3 to 10 wt %, of a pH regulating agent, and glycerol as balance.

The antioxidant of the composition will improve the antioxidant properties of the composition. In particular, the antioxidant prevents degradation of the aqueous lubricant composition such as degradation by decomposition and/or oxidation of the components of the composition. The antioxidant may be present in an amount from about 0.5 to about 10 wt %. For instance, the antioxidant may be present in an amount of about 0.5 wt %, about 3 wt %, about 5 wt %, about 10 wt % or from about 3 to about 10 wt %.

The antioxidant may be a phenol, polyphenol, or derivatives and/or mixtures thereof. Examples of suitable phenols or polyphenols include curcumin, sesamol, tea polyphenols, lignin, or derivatives and/or mixtures thereof. The antioxidant may also be selected from the group consisting of quercetin, flavone, rosmarinic acid, inositol hexaphosphate, or derivatives and/or mixtures thereof.

In this document, tea polyphenols intend the phenols and polyphenols, natural plant compounds which are found in tea. Examples of tea polyphenols include catechins, theaflavins, tannins, and flavonoids.

For instance, the antioxidant used in the aqueous composition described herein may be selected from the group consisting of curcumin, sesamol, tea polyphenols, flavone, rosmarinic acid, and inositol hexaphosphate. The amount of curcumin may be about 0.5 wt %. The amount of sesamol or flavone may be about 10 wt %. The amount of rosmarinic acid or inositol hexaphosphate may be about 3 wt %. The amount of tea polyphenols may be about 5 wt %.

The pH regulating agent of the composition may help adjusting the pH to a desired value. Suitable pH values of the biodegradable aqueous lubricant composition may range from about 8 to about 12 such as from about 9 to about 12 or from about 10 to about 12, which may allow for imparting anti-corrosive properties to the composition. For instance, the lubricant composition may have a pH of about 9, 10, 11 or 12.

Various pH regulating agents may include hydroxides and amines. The hydroxides may be alkaline earth metal hydroxides such as sodium hydroxide. Alternatively, the pH regulating agent may be an amine such as a primary, secondary or tertiary amine. An example of a suitable tertiary amine is triethylamine. The pH regulating agent may be a mixture of different pH regulating agents. The amount of the pH regulating agent may range from about 0.5 to about 5 wt %, from about 0.5 to about 4 wt %, from about 0.5 to about 3 wt %, from about 0.5 to about 2 wt %, from about 0.5 to about 1 wt %, from about 1 to about 5 wt %, from about 1 to about 5 wt %, from about 1 to about 3 wt % or from about 1 to about 2 wt %. Examples of amines that may be used in the aqueous lubricant composition described herein include ammonia, triethanolamine and triethylamine. Examples of hydroxides amines that may be used in the aqueous lubricant composition described herein include sodium hydroxide and calcium hydroxide.

For instance, a pH regulating agent used in the aqueous lubricant composition described herein may be selected from the group consisting of ammonia, triethanolamine and triethylamine, sodium hydroxide and calcium hydroxide. The amount of ammonia may be about 1 wt %. The amount of calcium hydroxide or sodium hydroxide may be about 0.5 wt %. The amount of triethanolamine may be about 5 wt %. The amount of triethylamine may be about 0.05 or about 1 wt %.

As an example, there is provided an aqueous lubricant composition, wherein said lubricant composition consists or essentially consists of: 5 wt % of water, 0.02 wt % of hydroxyethyl chitosan, 5 wt % of tea polyphenols, 5 wt % of triethanolamine and 84.98 wt % of glycerol.

In still a further example, there is provided an aqueous lubricant composition, wherein said lubricant composition consists or essentially consists of: 10 wt % of water, 0.04 wt % of hyaluronic acid, 3 wt % of inositol hexaphosphate, 1 wt % of triethylamine and 86.46 wt % of glycerol.

In still a further example, there is provided an aqueous lubricant composition, wherein said lubricant composition consists or essentially consists of: 30 wt % of water, 10 wt % of starch, 10 wt % of flavone, 0.5 wt % of triethylamine and 49.5 wt % of glycerol.

In still a further example, there is provided an aqueous lubricant composition, wherein said lubricant composition consists or essentially consists of: 40 wt % of water, 1 wt % of vegetable gums, 0.5 wt % of curcumin, 0.5 wt % of sodium hydroxide and 58.0 wt % of glycerol.

In still a further example, there is provided an aqueous lubricant composition, wherein said lubricant composition consists or essentially consists of: 20 wt % of water, 0.01 wt % of hydroxyethyl cellulose, 3 wt % of rosmarinic acid, 0.5 wt % of calcium hydroxide, and 76.49 wt % of glycerol.

In still a further example, there is provided an aqueous lubricant composition, wherein said lubricant composition consists or essentially consists of: 20 wt % of water, 0.02 wt % of hydroxyethyl chitosan, 5 wt % of tea polyphenols, 5 wt % of triethanolamine, and 69.98 wt % of glycerol.

In still a further example, there is provided an aqueous lubricant composition, wherein said lubricant composition consists or essentially consists of: 20 wt % of water, 10 wt % of dextrin, 10 wt % of sesamol, 1 wt % of ammonia, and 59 wt % of glycerol.

The aqueous lubricant composition described herein may be manufactured by mixing the thickener, the antioxidant and the pH regulating agent in water during stirring thereby providing an aqueous mixture. The mixing may take place at a temperature from 20 to 90° C. For instance, the temperature may be 20, 22 or 25° C. The time for stirring may be approximately two hours. Subsequently glycerol may be added to the aqueous mixture, and stirring may be continued for a certain time such as one hour.

Accordingly, there is provided a method for manufacturing an aqueous lubricant composition as described herein, said method comprising the steps of:

a) mixing a thickener, an antioxidant and a pH regulating agent in water, b) stirring the mixture obtained in step a), c) adding glycerol to the mixture obtained in step b), and d) stirring the mixture from step c).

The method may be performed at a temperature from 20 to 90° C., at ambient pressure. For instance, the temperature may be 20, 22 or 25° C. The time for stirring in step b) may be approximately 2 hours. The time for stirring in step d) may be approximately one hour. The thickener, antioxidant, pH regulating agent and glycerol may be as described herein. Further, the amounts of thickener, antioxidant, pH regulating agent, water and glycerol may be as described herein.

The aqueous lubricant composition described herein may be used in a large number of different applications. Due to its environmentally friendly character, it is especially suitable in applications where the lubricant applications may end up in the environment, for instance in outdoor applications. Examples of suitable applications include the lubrication of hydraulic power machines, chain saws, and railroad tracks. Thus, there is provided a use of the aqueous lubricant composition described herein for lubrication of devices such as hydraulic power machines, chain saws, and railroad tracks, metal working fluid, sawmill, conveyer belt, molding fluids etc. It can also be used as fire resistant lubricants or as hydraulic fluids. Further, the aqueous lubricant compositions described herein may be used alone or in combination with other lubricants, such as green lubricants.

The disclosure is further illustrated by the further non-limitative examples.

EXAMPLES

Biodegradable Aqueous Glycerol Composition. General Method of Preparation.

The aqueous lubricant composition described herein was manufactured by mixing the thickener, the antioxidant and the pH regulating agent in water at room temperature during stirring thereby providing an aqueous mixture. The time for stirring was approximately two hours. Subsequently glycerol was added to the aqueous mixture, and stirring was continued for a certain time such as one hour.

The tea polyphenols were purchased from Shaanxi Sciphar Hi-tech Industry Co., Ltd.

Measurement of Friction Coefficient, Wear Volume Loss and Viscosity of Various Compositions Description of Friction and Wear Test:

An Optimol SRV-III oscillating friction and wear tester was used to evaluate friction-reducing and anti-wear properties of the lubricants under boundary lubrication conditions, in accordance with the ASTM D 6425 protocol. During the test, the upper steel ball (100Cr6 steel, diameter 10 mm, surface roughness (Ra) 20 nm) slides under reciprocating motion against a stationary steel disc (100CR6 ESU hardened, Ø24 mm×7.9 mm, surface roughness (Ra) 120 nm). Both the ball and disc were supplied by Optimol Instruments Prüftechnik GmbH, Germany. Before each test the device and specimens were cleaned with acetone and ethanol. All tests were conducted under a load of 33N (2 GPa Maxium Hertzian pressure) at room temperature (ca 25° C.), a sliding frequency of 50 Hz, and an amplitude of 1 mm. The friction coefficient curves were recorded automatically with a data acquiring system linked to the SRV-III tester. The average value of the stable friction coefficient after the running in period was reported. After the friction tests the wear volumes of the lower discs were determined using an optical profiling system (Wyko NT1100, Veeco).

Description of Viscosity Test:

The viscosities of glycerol and its aqueous solutions at different shear rate were investigated using a Bohlin CVO 100 rheometer. A concentric cylinder geometry was used with a 25 mm diameter inner cylinder and a 27 mm diameter outer cylinder. During the experiments, the temperature of the lubricant was maintained at 25° C. throughout the measurement. The shear rate was 20 $s^{-1}$.

Description of pH Value Test:

A standard pH paper was used here to test the pH value.

The following 22 aqueous lubricant compositions were prepared as described above except for Example 1 and Example 2 in which pure glycerol and pure rapeseed oil, respectively, were used.

Example 1

Pure glycerol

Example 2

Pure rapeseed oil

Example 3

5% water in glycerol

Example 4

20% water in glycerol

Example 5

50% water in glycerol

Example 6

20 wt % of water,
Thickener: 0.02 wt % of sodium carboxymethyl cellulose
79.98 wt % of glycerol Example 7

20% of water,
20 wt % of dextrin
60 wt % of glycerol

Example 8

20 wt of % water
Antioxidant: 1 wt % of inositol hexaphosphate
79 wt % of glycerol Example 9

20 wt % of water
Antioxidant: 10 wt % of tea polyphenols
70 wt % of glycerol

Example 10

20 wt % of water
Thickener: 0.01 wt % of hydroxyethyl cellulose
Antioxidant: 3 wt % of rosmarinic acid pH regulating agent: 0.5 wt % of calcium hydroxide
76.49 wt % of glycerol Example 11

20% water,
Thickener: 0.02 wt % of hydroxyethyl chitosan,
Antioxidant: 5 wt % of tea polyphenols,
pH regulating agent: 5 wt % of triethanolamine
69.98 wt % of glycerol Example 12

20 wt % of water,
Thickener: 10 wt % of dextrin,
Antioxidant: 10 wt % of sesamol,
pH regulating agent: 1 wt % of ammonia
59 wt % of glycerol Example 13

20% water,
Thickener: 0.02 wt % of hydroxyethyl chitosan,
Antioxidant: 5 wt % of tea polyphenols, Example 14

20% water,
pH regulating agent: 5 wt % of triethanolamine
75 wt % of glycerol

Example 15

5% water,
Thickener: 0.02 wt % of hydroxyethyl chitosan,
Antioxidant: 5 wt % of tea polyphenols,
pH regulating agent: 5 wt % of triethanolamine
84.98 wt % of glycerol Example 16

50% water,
Thickener: 0.02 wt % of hydroxyethyl chitosan,
Antioxidant: 5 wt % of tea polyphenols,
pH regulating agent: 5 wt % of triethanolamine
39.98 wt % of glycerol Example 17

10% water,
90.00 wt % of glycerol

Example 18

10% water,
Thickener: 0.04 wt % of hyaluronic acid,
Antioxidant: 3 wt % of inositol hexaphosphate,
pH regulating agent: 1 wt % of triethylamine
85.96 wt % of glycerol Example 19

30% water,
70.00 wt % of glycerol

Example 20

30% water,
Thickener: 10 wt % of starch,
Antioxidant: 10 wt % of flavone,
pH regulating agent: 0.5 wt % of triethylamine
49.5 wt % of glycerol Example 21

40% water,
60.00 wt % of glycerol

Example 22

40% water,
Thickener: 1 wt % of vegetable gums,
Antioxidant: 0.5 wt % of curcumin,
pH regulating agent: 0.5 wt % of sodium hydroxide
58.00 wt % of glycerol The properties of the aqueous lubricant compositions of Examples 1 to 22 are shown in Table 1 below. pH was measured for Examples 10-16, Example 18, Example 20 and Example 22. In this document, $mm^3$ stands for cubic millimetres and Pa·s stands for Pascal·second. Rapeseed oil was used as a reference, since it is a commonly used lubricant of vegetable origin having properties with respect to friction and wear volume loss that are often considered satisfactory. Thus, an aqueous lubricant composition having a friction coefficient and/or wear volume loss of the same order of magnitude or lower than rapeseed oil may be considered to fulfil the requirements of a well performing and environmentally friendly lubricant.

TABLE 1

| Example No | Friction coefficient | Wear volume loss ($mm^3$) | Viscosity at 25° C. (Pa · s) | pH |
|---|---|---|---|---|
| 1 | 0.096 | $2.7 \times 10^{-5}$ | 0.892 | |
| 2 | 0.136 | $3.1 \times 10^{-5}$ | 0.059 | |
| 3 | 0.089 | $3.8 \times 10^{-5}$ | 0.356 | |
| 4 | 0.080 | $13.2 \times 10^{-5}$ | 0.047 | |
| 5 | 0.148 | $54.1 \times 10^{-5}$ | 0.007 | |
| 6 | 0.083 | $11.6 \times 10^{-5}$ | 0.797 | |
| 7 | 0.118 | $6.1 \times 10^{-5}$ | 0.098 | |
| 8 | 0.082 | $10.1 \times 10^{-5}$ | 0.048 | |
| 9 | 0.086 | $8.1 \times 10^{-5}$ | 0.072 | |
| 10 | 0.075 | $2.6 \times 10^{-5}$ | 0.078 | 11.2 |
| 11 | 0.068 | $1.3 \times 10^{-5}$ | 0.081 | 11.6 |
| 12 | 0.068 | $1.9 \times 10^{-5}$ | 0.089 | 10.2 |
| 13 | 0.070 | $5.7 \times 10^{-5}$ | 0.081 | 5.9 |
| 14 | 0.078 | $11.9 \times 10^{-5}$ | 0.051 | 11.6 |
| 15 | 0.072 | $0.6 \times 10^{-5}$ | 0.468 | 11.7 |
| 16 | 0.096 | $16.6 \times 10^{-5}$ | 0.022 | 11.5 |
| 17 | 0.083 | $7.6 \times 10^{-5}$ | 0.178 | |
| 18 | 0.088 | $2.2 \times 10^{-5}$ | 0.286 | 9.1 |
| 19 | 0.106 | $15.0 \times 10^{-5}$ | 0.019 | |
| 20 | 0.086 | $3.3 \times 10^{-5}$ | 0.039 | 9.3 |
| 21 | 0.0129 | $23.5 \times 10^{-5}$ | 0.009 | |
| 22 | 0.108 | $11.8 \times 10^{-5}$ | 0.022 | 10.6 |

As can be seen from Table 1 the aqueous lubricant composition with a water content of 20 wt % in Example 4 has an acceptable viscosity, a low friction coefficient but a wear volume loss clearly above that of pure rapeseed oil (Example 2). Equipment, tools and machines such as railroad tracks and chain saws should have a long life time and should require a minimum of maintenance, and it is therefore desirable that wear is kept low. A low wear volume loss therefore indicates that the aqueous lubricant composition is suitable as a lubricant composition. In Table 2, Examples 1-22 have been regrouped to show the wear volume loss for aqueous glycerol compositions with varying water content.

TABLE 2

| Example No. | Thickener, amount | Antioxidant, amount | pH agent amount | Water content | Wear volume loss ($mm^3$) |
|---|---|---|---|---|---|
| 3 | | | | 5 wt % | $3.8 \times 10^{-5}$ |
| 15 | Hydroxyethyl chitosan 0.02 wt % | Tea polyphenols 5 wt % | Triethanolamine 5 wt % | 5 wt % | $0.6 \times 10^{-5}$ |
| 17 | | | | 10 wt % | $7.6 \times 10^{-5}$ |
| 18 | Hyaluronic acid 0.04 wt % | Inositol hexaphosphate 3 wt % | Triethylamine 1 wt % | 10 wt % | $2.2 \times 10^{-5}$ |
| 4 | | | | 20 wt % | $13.2 \times 10^{-5}$ |
| 6 | Sodium carboxymethyl cellulose 0.02 wt % | | | 20 wt % | $11.6 \times 10^{-5}$ |
| 7 | Dextrin 20 wt % | | | 20 wt % | $6.1 \times 10^{-5}$ |
| 8 | | Inositol hexaphosphate 1 wt % | | 20 wt % | $10.1 \times 10^{-5}$ |
| 9 | | Tea polyphenols 10 wt % | | 20 wt % | $8.1 \times 10^{-5}$ |
| 10 | Hydroxyethyl cellulose 0.01 wt % | Rosmarinic acid 3 wt % | Calcium hydroxide 0.5 wt % | 20 wt % | $2.6 \times 10^{-5}$ |
| 11 | Hydroxyethyl chitosan 0.02 wt % | Tea polyphenols 5 wt % | Triethanolamine 5 wt % | 20 wt % | $1.3 \times 10^{-5}$ |
| 12 | Dextrin 10 wt % | Sesamol 10 wt % | Ammonia 1 wt % | 20 wt % | $1.9 \times 10^{-5}$ |
| 13 | Hydroxyethyl chitosan 0.02 wt % | Tea polyphenols 5 wt % | | 20 wt % | $5.7 \times 10^{-5}$ |
| 14 | | | Triethanolamine 5 wt % | 20 wt % | $11.9 \times 10^{-5}$ |
| 19 | | | | 30 wt % | $15.0 \times 10^{-5}$ |
| 20 | Starch 10 wt % | Flavone 10 wt % | Triethylamine 0.5% wt % | 30 wt % | $3.3 \times 10^{-5}$ |
| 21 | | | | 40 wt % | $23.5 \times 10^{-5}$ |
| 22 | Vegetable gums 1 wt % | Curcumin 0.5 wt % | Sodium hydroxide 0.5 wt % | 40 wt % | $11.8 \times 10^{-5}$ |
| 5 | | | | 50 wt % | $54.1 \times 10^{-5}$ |
| 16 | Hydroxyethyl chitosan 0.02 wt % | Tea polyphenols 5 wt % | Triethanolamine 5 wt % | 50 wt % | $16.6 \times 10^{-5}$ |

The presence of a thickener in the aqueous lubricant composition as shown for Examples 6 and 7, respectively, resulted in a composition providing a lower wear volume loss compared to a corresponding composition consisting of only water and glycerol (i.e. Example 4). In Example 6, a slight lowering of the wear volume loss can be seen. In Example 7 a significant lowering of the wear volume loss can be seen, which may be due to the large amount of the added thickener.

Similarly, the presence of an antioxidant in the aqueous lubricant composition as shown for Examples 8 and 9, respectively, resulted in a composition providing a lower wear volume loss compared to a corresponding composition consisting of only water and glycerol (i.e. Example 4).

Thus, it can be concluded that the presence of solely a thickener or solely an antioxidant in the aqueous lubricant composition lowers the wear volume loss. However, the lowered wear volume loss value is still clearly higher than the wear volume loss value of, for instance, rapeseed oil (Example 2).

Example 13 shows that the presence of a thickener and an antioxidant in the aqueous lubricant composition significantly lowers the wear volume loss in spite of the small amounts of added thickener and antioxidant. Thus, a synergistic effect is seen in the presence of a thickener and an antioxidant.

Example 14 shows that addition of a pH regulating agent to the aqueous lubricant composition lowers the wear volume loss by approximately 10% compared to a corresponding composition consisting of water and glycerol only (i.e. Example 4).

Examples 11, 12 and 13 show that the presence of a thickener, an antioxidant and a pH regulating agent in the aqueous lubricant composition significantly lowers the wear volume loss so that the wear volume loss values are less than or of the same order of magnitude as, for instance, pure rapeseed oil (Example 2). Thus, a synergistic effect is seen upon addition of a thickener, an antioxidant and a pH regulating agent to the aqueous lubricant composition. It can also be concluded that the presence of a pH regulating agent, in addition to regulating the pH of the composition, has a beneficial impact on the lubrication properties, in particular with respect to wear, of the aqueous lubricant composition.

Table 1 and Table 2 also show that, regardless of the water content of the aqueous lubricant composition, the presence of a thickener, an antioxidant and a pH regulating agent in the aqueous glycerol composition significantly lower the wear volume loss value.

It is noted that for aqueous lubricant compositions with a water content of 5, 10, 20 or 30 wt % the wear volume loss value is less than or of the same order of magnitude as that of pure rapeseed oil (Examples 15, 18, 10, 11, 12 and 20 compared to Example 2). For aqueous glycerol compositions with a water content of 40 or 50 wt %, the wear volume loss value is higher than that of pure rapeseed oil (Examples 22 and 16 compared to Example 2). However, for these aqueous lubricant compositions addition of a thickener, an antioxidant and a pH regulating agent still significantly lower the wear volume loss compared to a corresponding composition consisting of only water and glycerol (Example 22 compared to Example 21, and Example 16 compared to Example 5).

From the above it can be concluded that, depending on the application and the lubrication requirements associated therewith, an aqueous lubricant composition with desired properties with respect to, for instance, wear may be selected.

The invention claimed is:

1. An aqueous lubricant composition, characterized in that it is biodegradable, comprising:

5 to 25 wt % of water, 0.01-20 wt % of a thickening agent, 0.5-10 wt % of an antioxidant selected from the group consisting of curcumin, sesamol, tea polyphenols, lignin, or derivatives and/or mixtures thereof, 0.5-5 wt % of a pH regulating agent, and 40-93.99 wt % glycerol.

2. The aqueous lubricant composition according to claim 1, characterized in that it consists essentially of:

5 to 25 wt % of water, 0.01-20 wt % of the thickening agent, 0.5-10 wt % of the antioxidant, 0.5-5 wt % of the pH regulating agent, and 40-93.99 wt % glycerol.

3. The aqueous lubricant composition according to claim 1, characterized in that it consists of:

0.01-20 wt % of the thickening agent, 0.5-10 wt % of the antioxidant, 0.5-5 wt % of the pH regulating agent, and 40-93.99 wt % glycerol.

4. The aqueous lubricant composition according to claim 1, characterized in that the amount of water is from 5 to 20 wt %.

5. The aqueous lubricant composition according to claim 1, characterized in that the amount of the thickening agent is from 0.01 to 10 wt %.

6. The aqueous lubricant composition according to claim 1, characterized in that the amount of the antioxidant is from 3 to 10 wt %.

7. The aqueous lubricant composition according to claim 1, characterized in that the amount of the pH regulating agent is from 0.5 to 3 wt %.

8. The aqueous lubricant composition according to claim 1, characterized in that the thickening agent is selected from the group consisting of: chitin, chitosan, dextrin, cellulose, starch, vegetable gums, hyaluronic acid, and derivatives thereof.

9. The aqueous lubricant composition according to claim 8, wherein the thickening agent is selected from the group consisting of: chitin, chitosan, dextrin, cellulose, starch, vegetable gums and hyaluronic acid.

10. The aqueous lubricant composition according to claim 1, characterized in that the pH regulator is selected from the group consisting of hydroxides and amines.

11. The aqueous lubricant composition according to claim 10, characterized in that the hydroxide is an alkali metal hydroxide or an alkaline earth metal hydroxide.

12. The aqueous lubricant composition according to claim 10, characterized in that the pH regulating agent is selected from the group consisting of: ammonia, triethanolamine, triethylamine, sodium hydroxide and calcium hydroxide.

13. The aqueous lubricant composition according to claim 1, characterized in that said aqueous lubricant composition has a pH from 8 to 12.

14. A method for lubricating a device comprising applying the aqueous lubricant composition according to claim 1 to said device.

15. The method according to claim 14, wherein the device is a hydraulic power machine, a chain saw, at least part of a railroad track, sawmill, or conveyer belt.

16. A method for manufacturing an aqueous lubricant composition according to claim 1, said method comprising the steps of:

a) mixing a thickener, an antioxidant and a pH regulating agent in water, b) stirring the mixture obtained in step a), c) adding glycerol to the mixture obtained in step b), and d) stirring the mixture from step c).

17. An aqueous lubricant composition, characterized in that it is biodegradable, comprising:

5 to 25 wt % of water, 0.01-20 wt % of a thickening agent, 0.5-10 wt % of an antioxidant selected from the group consisting of curcumin, sesamol, tea polyphenols, flavone, rosmarinic acid, and inositol hexaphosphate, 0.5-5 wt % of a pH regulating agent, and 40-93.99 wt % glycerol.

18. The aqueous lubricant composition according to claim 17 characterized in that the amount of water is from 5 to 20 wt %.

19. The aqueous lubricant composition according to claim 17 characterized in that the thickening agent is selected from the group consisting of: chitin, chitosan, dextrin, cellulose, starch, vegetable gums, hyaluronic acid, and derivatives thereof.

* * * * *